US008615847B2

(12) United States Patent
Krajenke et al.

(10) Patent No.: US 8,615,847 B2
(45) Date of Patent: Dec. 31, 2013

(54) DIRECT ACTING CLOCK SPRING COUNTERBALANCED HINGE ASSEMBLY

(75) Inventors: Gary W. Krajenke, Warren, MI (US); Alvin N. Standard, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/487,686

(22) Filed: Jun. 4, 2012

(65) Prior Publication Data

US 2013/0318745 A1 Dec. 5, 2013

(51) Int. Cl.
*E05F 1/08* (2006.01)

(52) U.S. Cl.
USPC ..... 16/306; 16/289; 296/76

(58) Field of Classification Search
USPC ..... 16/304–308, 289, 295, 294, 302, 366, 16/368–370; 296/76, 193.08
See application file for complete search history.

(56) References Cited

U.S. PATENT DOCUMENTS

| | | | | |
|---|---|---|---|---|
| 5,235,725 | A * | 8/1993 | Rees | 16/298 |
| 5,419,012 | A * | 5/1995 | Lewis | 16/306 |
| 7,093,877 | B2 * | 8/2006 | Duffy | 296/76 |
| 7,536,748 | B2 * | 5/2009 | Renke et al. | 16/289 |
| 7,546,663 | B2 * | 6/2009 | Duffy | 16/306 |
| 7,730,584 | B2 * | 6/2010 | Duffy | 16/304 |
| 2005/0172453 | A1 * | 8/2005 | Duffy | 16/307 |
| 2006/0232090 | A1 * | 10/2006 | Duffy | 296/76 |

* cited by examiner

*Primary Examiner* — William Miller
(74) *Attorney, Agent, or Firm* — Quinn Law Group, PLLC

(57) ABSTRACT

A counterbalanced hinge assembly for rotatably supporting a decklid of a vehicle includes a hinge box and a support member rotatably attached to the hinge box. A linkage system interconnects the hinge box and the support member, and includes a wind-up link rotatably attached to the hinge box for rotation about a spring axis, and a driven link interconnecting the wind-up link and the support member. A planar coil spring is coiled about the spring axis and is coupled to both the hinge box and the wind-up link. The planar coil spring applies a torque to the wind-up link to rotate the wind-up link about the spring axis to assist movement of the support member from the closed position into the open position.

20 Claims, 3 Drawing Sheets

DIRECT ACTING CLOCK SPRING COUNTERBALANCED HINGE ASSEMBLY

TECHNICAL FIELD

The invention generally relates to a counterbalanced hinge assembly.

BACKGROUND

Counterbalanced hinge assemblies that are used to rotatably support a decklid of a vehicle typically include at least one torque rod that extends between a pair of hinge boxes. A support member is rotatably attached to and supported by each of the hinge boxes, with the decklid attached to the support members for rotation therewith. One end of the torque rod is bent to define a wind-up end that engages one of the hinge boxes, and the other end of the torque rod is bent to define a looped end that engages one of the support members. Accordingly, the torque rod must extend across a width of the vehicle between the opposing hinge boxes. The torque rod is twisted during assembly and secured in a position relative to the hinge box to pre-load the torque rod. The pre-loaded torque rod acts as a spring to untwist, thereby applying a torque to the support member to assist in opening the decklid.

The shorter the effective length of the torque rod, the higher the stress is acting on the torque rod. Accordingly, reducing the effective length of the torque rod tends to lower the durability of the torque rod, whereas increasing the effective length of the torque rod tends to increase the durability of the torque rod. However, the effective length of the torque rod is limited by the cross vehicle width. As vehicles have gotten smaller over time, the cross width of the vehicles has also been reduced, thereby reducing the effective length of the torque rod. Additionally, packaging considerations require that the torque rod compete with other vehicular components, such as speakers, seat belt retractors, powered sun shades, etc., for space under the shelf within the trunk.

SUMMARY

A counterbalanced hinge assembly is provided. The counterbalanced hinge assembly includes a hinge box. A support member is rotatably attached to the hinge box for rotation about a rotation axis between a closed position and an open position. A linkage system interconnects the hinge box and the support member. The linkage system includes a wind-up link and a driven link. The wind-up link is rotatably attached to the hinge box for rotation about a spring axis. The wind-up link extends radially away from the spring axis to a distal pivot axis that is laterally spaced from the spring axis. The driven link includes a first end and a second end. The first end is rotatably attached to the wind-up link at the distal pivot point. The second end is rotatably attached to the support member. A planar coil spring is coiled about the spring axis and is coupled to both the hinge box and the wind-up link. The planar coil spring is configured to apply a torque to the wind-up link to rotate the wind-up link about the spring axis to assist movement of the support member from the closed position into the open position.

A vehicle is also provided. The vehicle includes a body extending along a longitudinal axis and defining an opening. A decklid is coupled to the body and configured for sealing the opening. A counterbalanced hinge assembly rotatably attaches the decklid to the body for rotation about a rotation axis between a closed position and an open position. The decklid hinge assembly includes a hinge box. A support member is rotatably attached to the hinge box and supports the decklid for rotation with the decklid about a rotation axis between a closed position and an open position. A linkage system interconnects the hinge box and the support member. The linkage system includes a wind-up link and a driven link. The wind-up link is rotatably attached to the hinge box for rotation about a spring axis. The wind-up link extends radially away from the spring axis to a distal pivot axis laterally spaced from the spring axis. The driven link includes a first end and a second end. The first end is rotatably attached to the wind-up link at the distal pivot point. The second end is rotatably attached to the support member. At least one clock spring is coiled about the spring axis and coupled to both the hinge box and the wind-up link. The at least one clock spring is configured to apply a torque to the wind-up link to rotate the wind-up link about the spring axis to assist movement of the support member from the closed position into the open position.

Accordingly, the counterbalanced hinge assembly includes the planar coil spring, e.g., a clock spring, to store and provide the torque to assist in moving the support member from the closed position into the open position. As such, the counterbalanced hinge assembly described herein does not require a lengthy torque rod that extends across a width of the vehicle, thereby freeing up packaging space within a trunk of the vehicle.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figure 1:
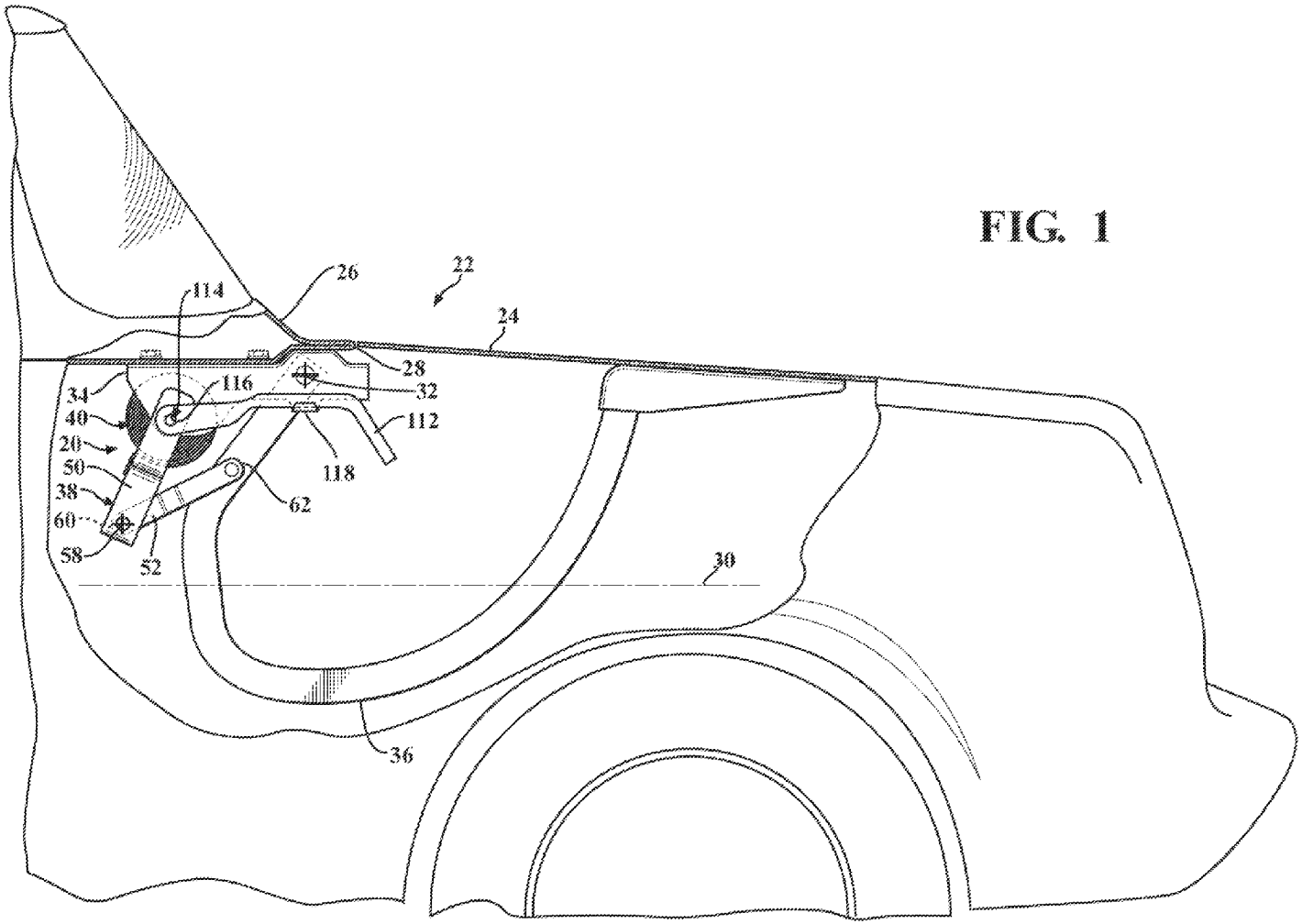
FIG. 1 is a schematic cross sectional view from a side of a vehicle showing a counterbalanced hinge assembly.

Referring to the Figures, wherein like numerals indicate like parts throughout the several views, a vehicle is generally shown at 22. Referring to FIG. 1, the vehicle is depicted as a sedan having a trunk disposed at a rearward end of a body 26 of the vehicle 22, the rearward end of the vehicle 22 being shown in FIG. 1. It should be understood that the vehicle 22 includes at least one power source, such as but not limited to an internal combustion engine and/or an electric motor, which powers the vehicle 22 to rotate at least one drive wheel. While depicted as a sedan, it should be appreciated that the specific shape and/or configuration of the vehicle 22 may differ from that shown in FIG. 1.

The vehicle 22 includes a counterbalanced hinge assembly, hereinafter referred to as the hinge assembly 20. The hinge assembly 20 rotatably couples a decklid 24 to the body 26 of the vehicle 22. The decklid 24 seals an opening 28 defined by the body 26, such as for example, the trunk or cargo area of the vehicle 22. While only a single hinge assembly 20 is shown and described herein, it should be appreciated that the vehicle 22 may include a pair of hinge assemblies, one each on opposing lateral sides of the vehicle 22 for simultaneously supporting the decklid 24, with each of the hinge assemblies being mirror images of each other and not directly connected to each other. While the hinge assembly 20 is described and shown herein for use supporting the decklid 24, it should be appreciated that the hinge assembly 20 may be used for alternative purposes not shown or described herein.

The body 26 extends along a longitudinal axis 30 between a forward end and the rearward end. The hinge assembly 20 rotatably attaches the decklid 24 to the body 26 for rotation about a rotation axis 32. As shown, the rotation axis 32 is perpendicular relative to the longitudinal axis 30 of the vehicle 22. However, the relative positions between the rotation axis 32 and the longitudinal axis 30 of the vehicle 22 may differ from that shown and described herein. The decklid 24 is rotatable between a closed position for sealing the opening 28, and an open position for allowing access to the opening 28.

Figure 2:
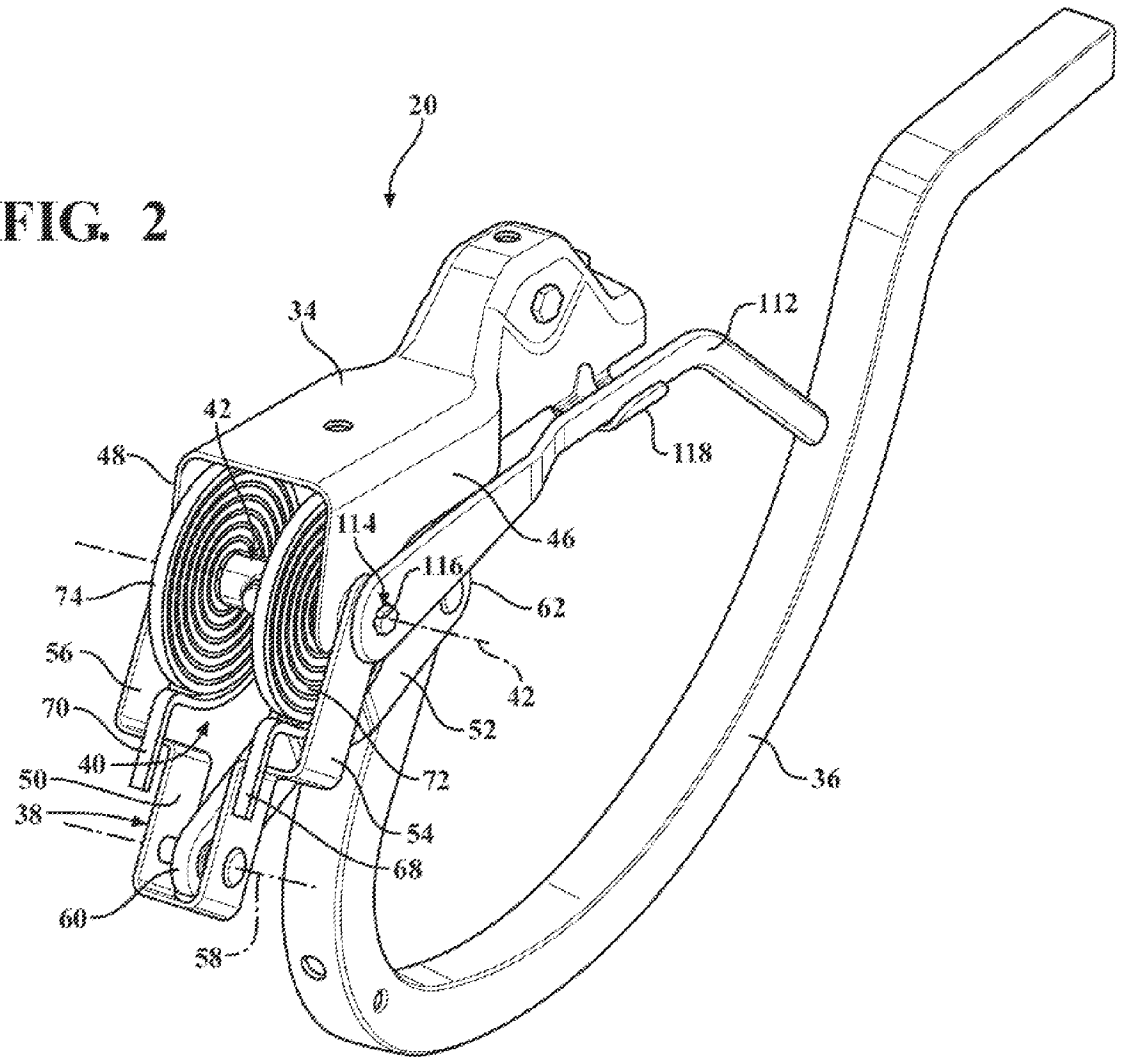
FIG. 2 is a schematic perspective view of the counterbalanced hinge assembly.
Figure 3:
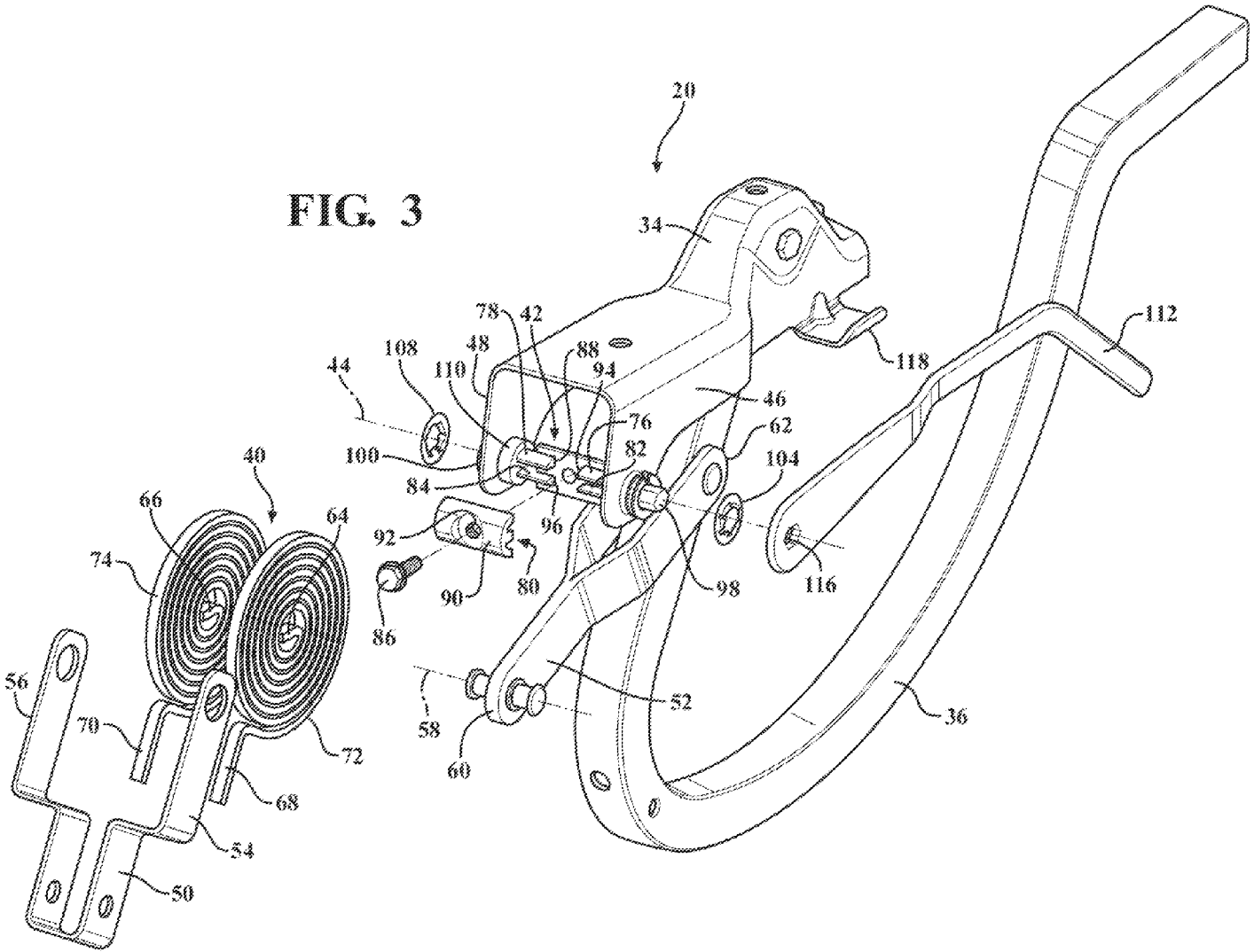
FIG. 3 is a schematic exploded perspective view of the counterbalanced hinge assembly.

Referring also to FIGS. 2 and 3, the hinge assembly 20 includes a hinge box 34. The hinge box 34 is attached to the body 26. The hinge box 34 may be attached to the body 26 in any suitable fashion, such as for example, with fasteners such as bolts and/or screws. A support member 36 is rotatably attached to the hinge box 34. The support member 36 is attached to and supports the decklid 24 relative to the body 26. The support member 36 is configured for rotation about the rotation axis 32 between the closed position and the open position to rotate the decklid 24 between the closed position and the open position. The support member 36 may be shaped in any suitable manner, such as but not limited to the gooseneck configuration shown in the Figures.

Referring also to FIGS. 2 and 3, a linkage system 38 interconnects the hinge box 34 and the support member 36. The linkage system 38 transfers a torque from a planar coil spring 40 to the support member 36. The torque applied to the support member 36 assists the movement of the support member 36 from the closed position into the open position.

A shaft assembly 42 supports the planar coil spring 40 and secures the planar coil spring 40 relative to the hinge box 34. The shaft assembly 42 is concentrically disposed about a spring axis 44. The hinge box 34 includes a first flange 46 and a second flange 48. The second flange 48 is disposed parallel with and spaced from the first flange 46. The shaft assembly 42 is coupled to, supported by and extends between the first flange 46 and the second flange 48 of the hinge box 34.

The linkage system 38 includes a wind-up link 50 and a driven link 52. The wind-up link 50 is coupled to the shaft assembly 42 for rotation about the spring axis 44 relative to the hinge box 34. The wind-up link 50 includes a first arm 54 and a second arm 56. The first arm 54 is coupled to the shaft assembly 42 adjacent the first flange 46. The second arm 56 is coupled to the shaft assembly 42 adjacent the second flange 48. The first arm 54 and the second arm 56 of the wind-up link 50 extend radially away from the spring axis 44 to a distal pivot axis 58, which is laterally spaced from the spring axis 44. The driven link 52 includes a first end 60 that is rotatable coupled to the wind-up link 50 at the pivot axis 58, and a second end 62 that is rotatably coupled to the support member 36.

The planar coil spring 40 is coiled about the spring axis 44 and is coupled to the hinge box 34 and the wind-up link 50. The planar coil spring 40 is coupled to the hinge box 34 via the shaft assembly 42. The planar coil spring 40 is configured to apply a torque to the wind-up link 50 to rotate the wind-up link 50 about the spring axis 44, thereby moving the driven link 52 and the support member 36, to assist movement of the support member 36 from the closed position into the open position. As such, the planar coil spring 40 biases the wind-up link 50 against the hinge box 34 to rotate the wind-up link 50.

The planar coil spring 40 may include a coiled spring in which the coils are disposed on a common plane, such as but not limited to a clock spring. As shown, the planar coil spring 40 includes a first spring 72 and a second spring 74. However, it should be appreciated that the planar coil spring 40 need only include a single spring. The planar coil spring 40 includes an interior end 64, 66. More specifically, the first spring 72 includes an interior end 64, and the second spring 74 includes an interior end 66. The interior ends 64, 66 are supported by the shaft assembly 42 and engage the shaft assembly 42 in interlocking engagement to prevent relative rotation between the interior ends 64, 66 of the first spring 72 and the second spring 74 relative to the shaft assembly 42. The planar coil spring 40 further includes an exterior end 68, 70. More specifically, the first spring 72 includes an exterior end 68, and the second spring 74 includes an exterior end 70. The exterior ends 68, 70 engage the wind-up link 50 for applying the torque to the wind-up link 50.

The first spring 72 includes a first spring rate, and the second spring 74 includes a second spring rate. The first spring rate of the first spring 72 may be equal to or different than the second spring rate of the second spring 74. Accordingly, the spring force supplied by the planar coil spring 40, including both the first spring 72 and the second spring 74, may be adjusted to meet requirements of any particular purpose by adjusting the spring rates of one or both of the first spring 72 and/or the second spring 74.

As shown, the shaft assembly 42 includes a drive portion 76 and a driven portion 78. A clamping device 80 interconnects and secures the drive portion 76 and the driven portion 78 together for common rotation about the spring axis 44. The drive portion 76 is rotatably attached to the first flange 46, and the driven portion 78 is rotatably attached to the second flange 48. As shown in FIG. 3, each of the drive portion 76 and the driven portion 78 of the shaft assembly 42 may include a slot 82, 84 extending axially into the drive portion 76 and the driven portion 78 respectively. The slot 82 in the drive portion 76 is configured to receive the interior end 64 of the first spring 72 in interlocking engagement, and the slot 84 in the driven portion 78 is configured to receive the interior end 66 of the second spring 74 in interlocking engagement. The exterior end 68 of the first spring 72 and the exterior end 70 of the second spring 74 each engage the wind-up link 50, and are configured to bias the wind-up link 50 in a rotational direction about the spring axis 44.

The clamping device 80 is disposed between the first spring 72 and the second spring 74 to restrict axial movement of either the first spring 72 or the second spring 74 along the spring axis 44, and to prevent the interior ends 64, 66 of either the first spring 72 or the second spring 74 from becoming dislodged from the slots 82, 84 in either the drive portion 76 or the driven portion 78 respectively.

As shown in FIG. 3, the clamping device 80 includes a fastener 86, a threaded coupler 88, and a coupler cap 90 defining an aperture 92. The fastener 86 extends through the aperture 92 of the coupler cap 90 into threaded engagement with the threaded coupler 88 to draw the threaded coupler 88 into clamping engagement with the coupler cap 90, thereby clamping the drive portion 76 and the driven portion 78 between the threaded coupler 88 and the coupler cap 90. Opposing surfaces of the threaded coupler 88 and the coupler cap 90 may be shaped to receive axial edges of an inner axial end 94 of the drive portion 76 and an inner axial end 96 of the driven portion 78 in interlocking mechanical engagement to prevent relative rotation between the threaded coupler 88 and the coupler cap 90, and either the drive portion 76 or the driven portion 78 of the shaft assembly 42.

The drive portion 76 of the shaft assembly 42 includes an outer axial end 98 that extends outboard of the first flange 46 and the first arm 54 of the wind-up link 50. The driven portion 78 of the shaft assembly 42 includes an outer axial end 100 that extends inboard of the second flange 48 and the second arm 56 of the wind-up link 50. As used herein, the term outboard is defined as being disposed farther from the longitudinal axis 30, and the term inboard is defined as being disposed nearer the longitudinal axis 30. Accordingly, the outer axial end 98 of the drive portion 76 is disposed farther from the longitudinal axis 30 than the first arm 54 of the wind-up link 50 and the first flange 46 of the hinge box 34, and the outer axial end 100 of the driven portion 78 is disposed nearer the longitudinal axis 30 than the second arm 56 of the wind-up link 50 and the second flange 48 of the hinge box 34.

A first retainer clip 104 is coupled to the drive portion 76 adjacent the outer axial end 98 of the drive portion 76. The first retainer clip 104 resists axial movement of the drive portion 76 of the shaft assembly 42 along the spring axis 44 in an inboard direction relative to the first flange 46. The drive portion 76 may further include a radially extending lip (not shown) that engages an inner surface of the first flange 46 in abutting engagement to resist axial movement of the drive portion 76 of the shaft assembly 42 along the spring axis 44 in an outboard direction relative to the first flange 46. A second retainer clip 108 is coupled to the driven portion 78 adjacent the outer axial end 100 of the driven portion 78. The second retainer clip 108 resists axial movement of the driven portion 78 of the shaft assembly 42 along the spring axis 44 in an outboard direction relative to the second flange 48. The driven portion 78 may further include a radially extending lip 110 that engages an inner surface of the second flange 48 in abutting engagement to resist axial movement of the driven portion 78 of the shaft assembly 42 along the spring axis 44 in an inboard direction relative to the second flange 48.

A lever 112 may be attached to and rotatable with the outer axial end 98 of the drive portion 76. The lever 112 is rotationally fixed relative to the outer axial end 98 of the drive portion 76 of the shaft assembly 42 such that rotation of the lever 112 rotates the drive portion 76 of the shaft assembly 42. As the clamping device 80 rotatably secures the driven portion 78 of the shaft assembly 42 relative to the drive portion 76 of the shaft assembly 42 for rotation about the spring axis 44, it should be appreciated that rotation of the drive portion 76 about the spring axis 44 simultaneously rotates the driven portion 78 about the spring axis 44.

As shown in FIGS. 2 and 3, the lever 112 may include a rotational locking mechanism 114 rotationally securing the lever 112 to the outer axial end 98 of the drive portion 76. The rotational locking mechanism 114 may include any mechanism capable of rotationally securing the lever 112 to the drive portion 76. For example, referring to FIGS. 2 and 3, the rotational locking mechanism 114 may include a lever aperture 116 extending through the lever 112 and having a non-annular cross sectional shape corresponding to a non-annular cross sectional shape of the outer axial end 98 of the drive portion 76. As shown, the lever aperture 116 defines a hexagonal cross sectional shape that mates with a hexagonal exterior shape of the outer axial end 98 of the drive portion 76. However, it should be appreciated that other non-annular corresponding shapes between the lever aperture 116 and the outer axial end 98 of the drive portion 76 may alternatively be used.

The planar coil spring 40, including both the first spring 72 and the second spring 74 in the exemplary embodiment shown and described herein, is twisted by rotation of the lever 112 about the spring axis 44 to generate the torque that is stored within the planar coil spring 40. During assembly, the lever 112 is rotated into position and secured in that position relative to the hinge box 34. The rotation of the lever 112 about the spring axis 44 twists the planar coil spring 40, via the interlocking engagement between the interior end 64, 66 of the planar coil spring 40 and the shaft assembly 42, between the shaft assembly 42 and the wind-up link 50, thereby generating the torque used to assist in opening the decklid 24. The hinge box 34 includes a retention feature 118 that is configured for securing the lever 112 in position relative to the hinge box 34. The retention feature 118 prevents the rotation of the lever 112 in a direction that would allow the planar coil spring 40 to untwist, and also resists lateral movement away from the longitudinal axis 30 to prevent unintentional disengagement of the lever 112 from the retention feature 118.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A counterbalanced hinge assembly comprising:

a hinge box;

a support member rotatably attached to the hinge box for rotation about a rotation axis between a closed position and an open position;

a linkage system interconnecting the hinge box and the support member;

wherein the linkage system includes a wind-up link rotatably attached to the hinge box for rotation about a spring axis and extending radially away from the spring axis to a distal pivot axis laterally spaced from the spring axis, and a driven link having a first end rotatably attached to the wind-up link at the distal pivot point and a second end rotatably attached to the support member; and a planar coil spring coiled about the spring axis and coupled to both the hinge box and the wind-up link, wherein the planar coil spring applies a torque to the wind-up link to rotate the wind-up link about the spring axis to assist movement of the support member from the closed position into the open position.

2. A counterbalanced hinge assembly as set forth in claim 1 wherein the planar coil spring includes an interior end coupled to the hinge box, an exterior end coupled to the wind-up link, and biases the wind-up link against the hinge box.

3. A counterbalanced hinge assembly as set forth in claim 1 wherein the planar coil spring includes a first spring having a first spring rate and a second spring having a second spring rate.

4. A counterbalanced hinge assembly as set forth in claim 3 wherein the first spring rate of the first spring is different than the second spring rate of the second spring.

5. A counterbalanced hinge assembly as set forth in claim 3 further comprising a shaft assembly supporting the planar coil spring and securing the planar coil spring relative to the hinge box.

6. A counterbalanced hinge assembly as set forth in claim 5 wherein the shaft assembly is concentrically disposed about the spring axis.

7. A counterbalanced hinge assembly as set forth in claim 5 wherein the hinge box includes a first flange and a second flange disposed parallel with and spaced from the first flange, and wherein the shaft assembly is coupled to, supported by and extends between the first flange and the second flange of the hinge box.

8. A counterbalanced hinge assembly as set forth in claim 7 wherein the shaft assembly includes a drive portion rotatably attached to the first flange and a driven portion rotatably attached to the second flange.

9. A counterbalanced hinge assembly as set forth in claim 8 wherein the shaft assembly includes a clamping device configured to interconnect and secure the drive portion and the driven portion together for common rotation about the spring axis.

10. A counterbalanced hinge assembly as set forth in claim 9 wherein the clamping device includes a fastener, a threaded coupler, and a coupler cap defining an aperture, with the fastener extending through the aperture of the coupler cap into threaded engagement with the threaded coupler to draw the threaded coupler into clamping engagement with the coupler cap to clamp the drive portion and the driven portion between the threaded coupler and the coupler cap.

11. A counterbalanced hinge assembly as set forth in claim 9 wherein the first spring includes an interior end supported by the drive portion in interlocking mechanical engagement with the drive portion, and the second spring includes an interior end supported by the driven portion in interlocking mechanical engagement with the driven portion.

12. A counterbalanced hinge assembly as set forth in claim 11 wherein the clamping device is disposed between the first spring and the second spring.

13. A counterbalanced hinge assembly as set forth in claim 11 wherein each of the first spring and the second spring includes an exterior end engaging the wind-up link and configured to bias the wind-up link in a rotational direction about the spring axis.

14. A counterbalanced hinge assembly as set forth in claim 8 further comprising a lever fixedly attached to the drive portion of the shaft assembly for rotation with the drive portion about the spring axis.

15. A counterbalanced hinge assembly as set forth in claim 14 wherein the hinge box includes a retention feature configured for securing the lever in a position relative to the hinge box to prevent rotation of the lever in a direction that would un-coil the planar coil spring.

16. A counterbalanced hinge assembly as set forth in claim 8 further comprising a first retainer clip coupled to the drive portion and configured to resist axial movement of the drive portion along the spring axis in an outboard direction relative to the first flange, and a second retainer clip coupled to the driven portion and configured to resist axial movement of the driven portion along the spring axis in an outboard direction relative to the second flange.

17. A vehicle comprising:

a body extending along a longitudinal axis and defining an opening;

a decklid coupled to the body and configured for sealing the opening;

a counterbalanced hinge assembly rotatably attaching the decklid to the body for rotation about a rotation axis between a closed position and an open position, the decklid hinge assembly including:

a hinge box;

a support member rotatably attached to the hinge box and supporting the decklid for rotation with the decklid about a rotation axis between a closed position and an open position;

a linkage system interconnecting the hinge box and the support member;

wherein the linkage system includes a wind-up link rotatably attached to the hinge box for rotation about a spring axis and extending radially away from the spring axis to a distal pivot axis laterally spaced from the spring axis, and a driven link having a first end rotatably attached to the wind-up link at the distal pivot point and a second end rotatably attached to the support member; and at least one clock spring coiled about the spring axis and coupled to both the hinge box and the wind-up link, wherein the at least one clock spring applies a torque to the wind-up link to rotate the wind-up link about the spring axis to assist movement of the support member from the closed position into the open position.

18. A vehicle as set forth in claim 17 wherein the at least one clock spring includes a first spring having a first spring rate and a second spring having a second spring rate, wherein the first spring rate of the first spring is different than the second spring rate of the second spring.

19. A vehicle as set forth in claim 17 further comprising:

a shaft assembly supporting the first spring and the second spring relative to the hinge box;

wherein each of the first spring and the second spring includes an interior end and an exterior end;

wherein the shaft assembly engages the interior end of both the first spring and the second spring in interlocking mechanical engagement; and wherein the exterior end of each of the first spring and the second spring engages the wind-up link and is configured to bias the wind-up link in a rotational direction about the spring axis.

20. A vehicle as set forth in claim 19 further comprising a lever fixedly attached to the shaft assembly for rotation with the shaft assembly about the spring axis, and wherein the hinge box includes a retention feature configured for securing the lever in a position relative to the hinge box to prevent rotation of the lever in a direction that would un-coil the planar coil spring.

* * * * *